US006823135B1

(12) United States Patent
Greene

(10) Patent No.: US 6,823,135 B1
(45) Date of Patent: Nov. 23, 2004

(54) WASTE ENERGY RECOVERY SYSTEM, INCLUDING METHOD OF RECOVERING WASTE ENERGY FROM FLUIDS, AND PIPES HAVING THERMALLY INTERRUPTED SECTIONS

(76) Inventor: Randolph W. Greene, P.O. Box 651, Newberry, FL (US) 32669

( * ) Notice: Subject to any disclaimer, the term of this patent is extended or adjusted under 35 U.S.C. 154(b) by 35 days.

(21) Appl. No.: 10/461,363

(22) Filed: Jun. 16, 2003

(51) Int. Cl.[7] ..... F28D 7/00
(52) U.S. Cl. ..... 392/496; 165/135
(58) Field of Search ..... 392/465, 466, 392/485, 496; 165/135, 136, 148, 154, 157

(56) References Cited

U.S. PATENT DOCUMENTS 4,080,181 A 3/1978 Feistel et al.
4,168,743 A 9/1979 Arai et al.
4,217,954 A 8/1980 Vincent
4,852,645 A 8/1989 Coulon et al.
4,949,781 A 8/1990 Porowski
5,211,220 A 5/1993 Swozil et al.
5,694,515 A 12/1997 Goswami et al.

*Primary Examiner*—Thor Campbell
(74) *Attorney, Agent, or Firm*—Shlesinger, Arkwright & Garvey LLP

(57) ABSTRACT

Heat exchanger particularly suited for transferring heat from a fluid transfer device to the environment, to another object, or to another heat transfer device, includes one or more insulating segments disposed along the fluid path. The insulated segments thermally interrupt adjacent sections of the fluid transfer device for preventing heat transfer along the length of the fluid transfer device; rather, heat is transferred outwardly away from each thermally interrupted or isolated section of the fluid transfer device. In the case where the thermally isolated section fluid transfer pipe is used for waste heat recovery, a further fluid transfer device may be provided adjacent the fluid transfer device. Each fluid transfer device may have respective thermally isolated sections for maximizing the temperature gradient and, hence, the heat transfer between adjacent fluid transfer devices.

26 Claims, 5 Drawing Sheets

FIG. 4
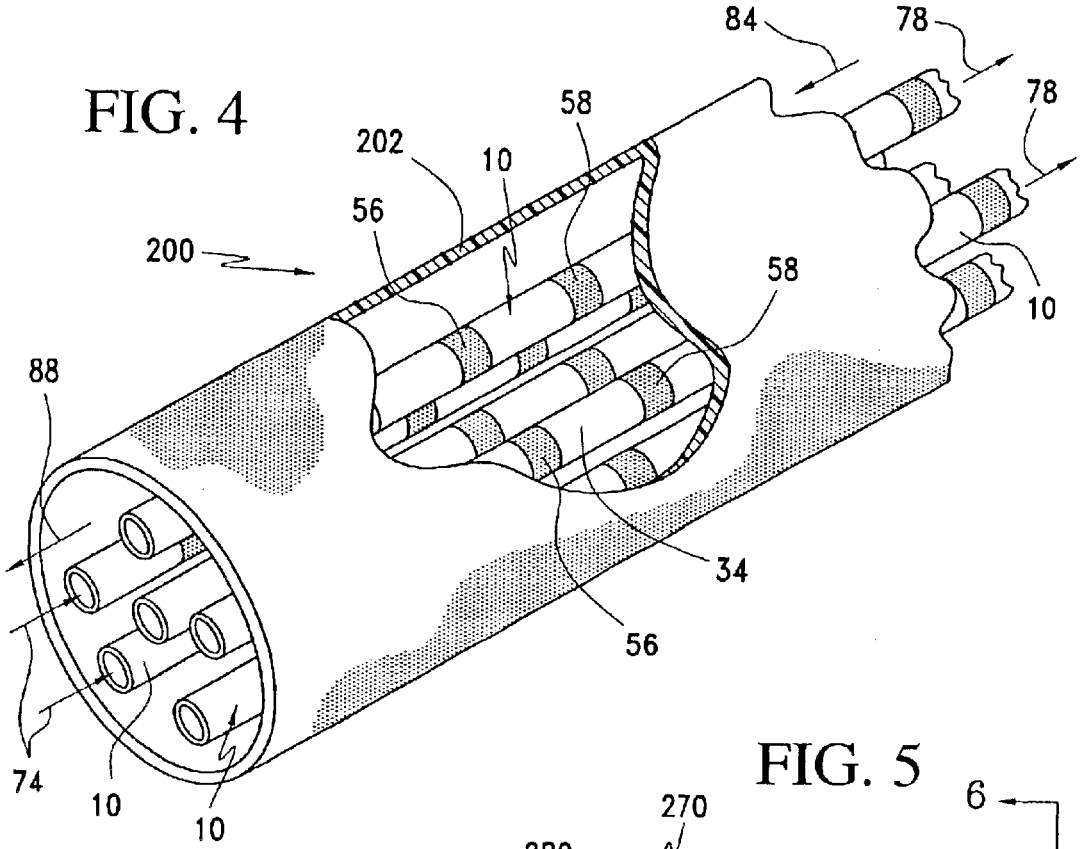
FIG. 5
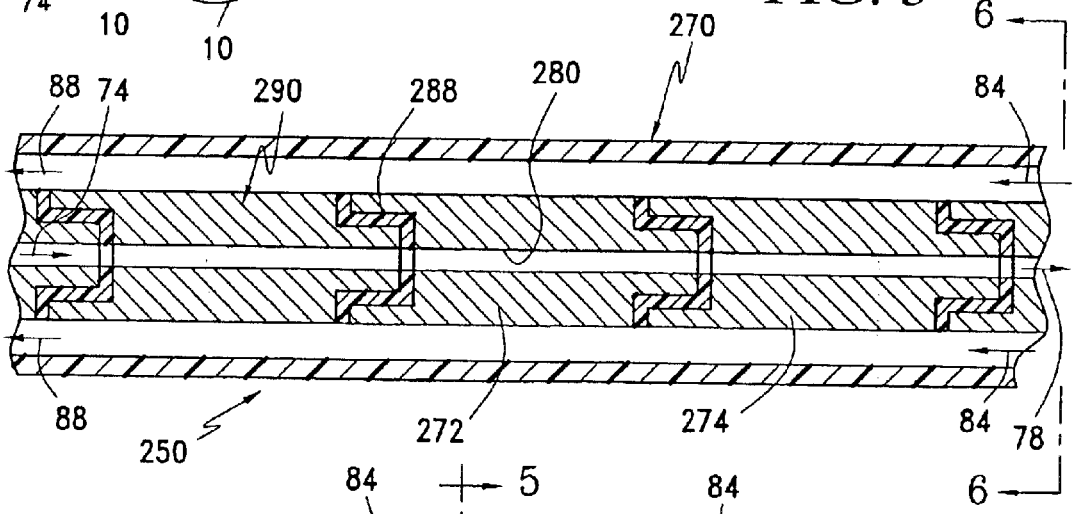
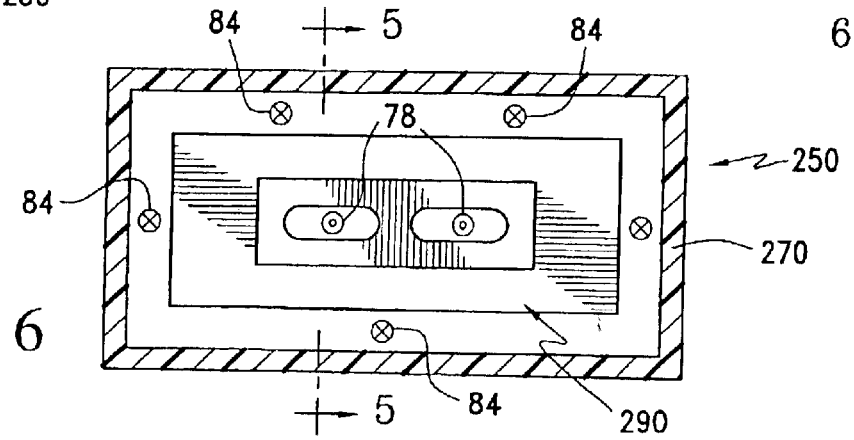
FIG. 6

FIG. 7
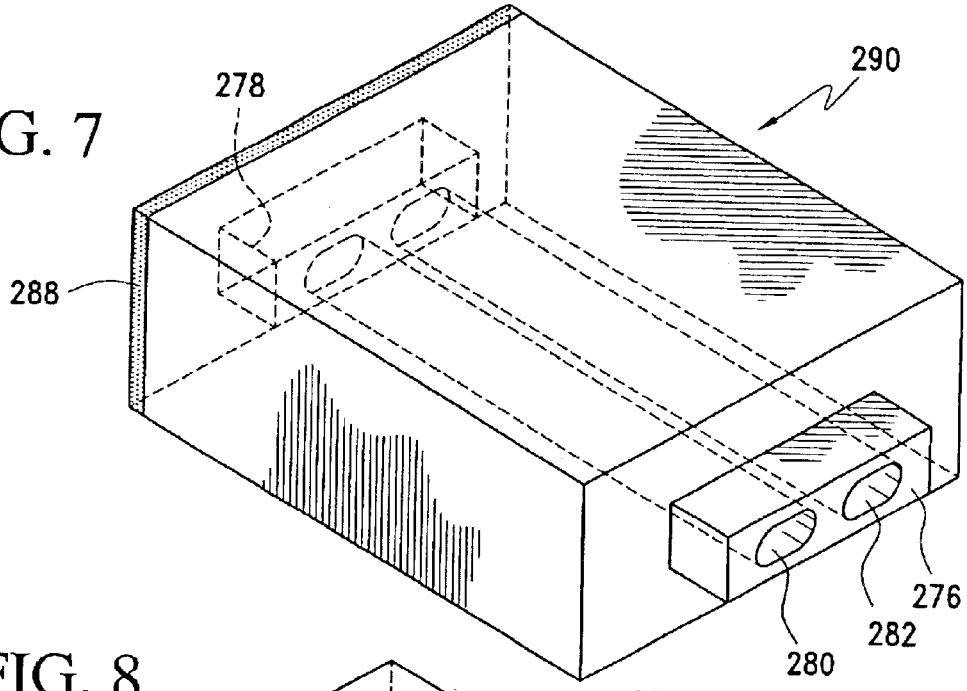
FIG. 8
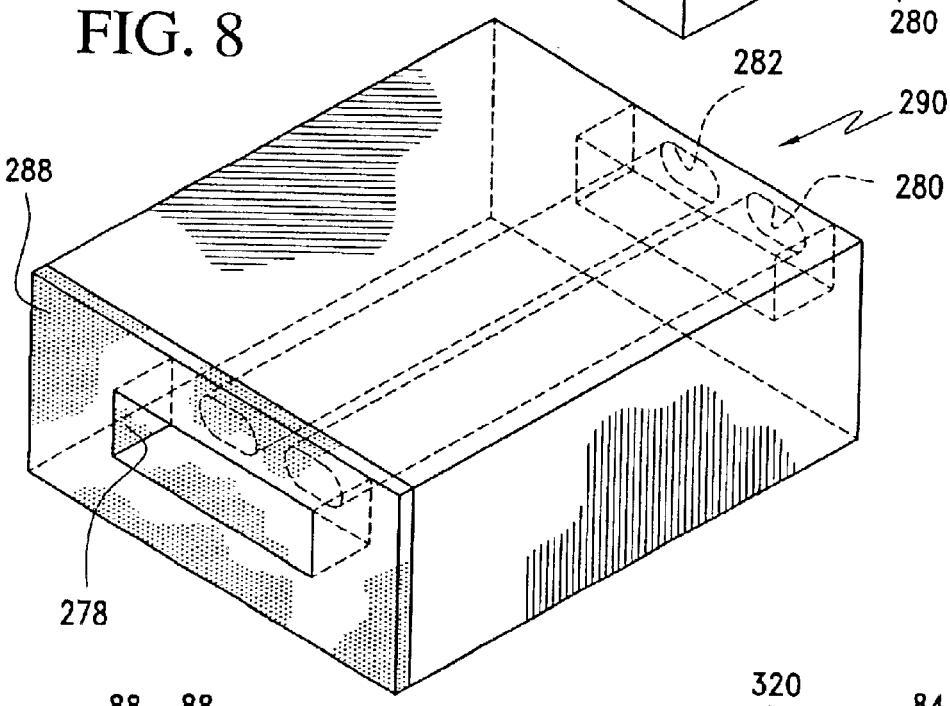
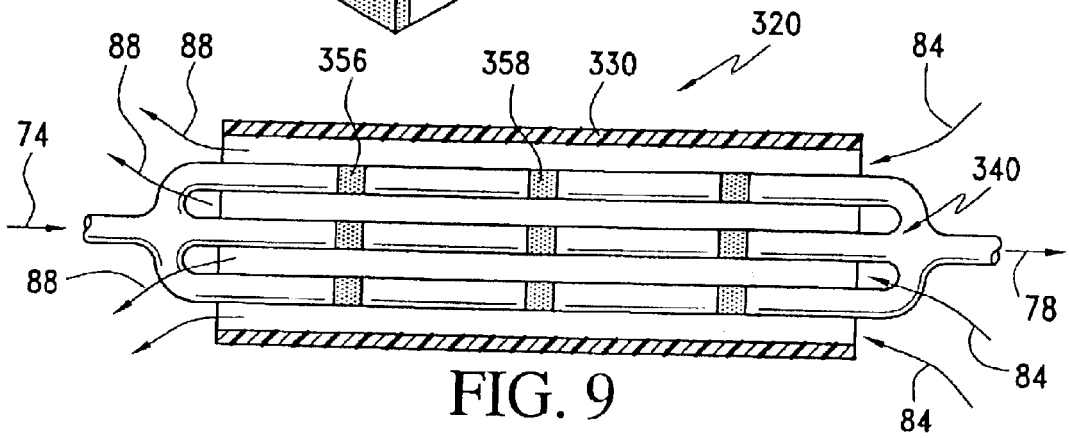
FIG. 9

WASTE ENERGY RECOVERY SYSTEM, INCLUDING METHOD OF RECOVERING WASTE ENERGY FROM FLUIDS, AND PIPES HAVING THERMALLY INTERRUPTED SECTIONS

FIELD OF THE INVENTION

The invention relates to waste energy recovery systems. More particularly, the invention relates to systems which recover "waste" or excess heat from energy systems, such as cooling water systems and power plants, engine cooling radiator systems in automobiles, and the like. Even more particularly, the invention relates to fluid transfer devices such as pipes, which pipes are subdivided into thermally interrupted sections so that the amount of heat transfer from one fluid to another fluid is maximized, thereby maximizing the amount of energy recovery.

BACKGROUND OF THE INVENTION

Systems are known for using heated fluid to transfer heat from one source to another. For example, heated water is used in diesel fuel furnace heated radiator systems, such as hot water radiator systems in houses, to transfer heat from the heater or furnace to a closed loop fluid system, which in turn, transfers heat to heated water for household radiators or consumption.

Other fluid heat transfer systems are known, such as used in power plants, automobile engine applications, and the like.

Examples of known systems include those set forth in the following United States Patents:

U.S. Pat. No. 4,080,181 to Feistel et al.

U.S. Pat. No. 4,168,743 to Arai et al.

U.S. Pat. No. 4,217,954 to Vincent

U.S. Pat. No. 5,694,515 to Goswami et al.

U.S. Pat. No. 4,852,645 to Coulon et al.

U.S. Pat. No. 4,949,781 to Porowski

U.S. Pat. No. 5,211,220 to Swozil et al.

OBJECTS AND SUMMARY OF THE INVENTION

An object of the invention is to overcome the drawbacks of the prior art.

Another object of the invention is to maximize heat transfer between two (2) bodies; e.g., between a first fluid and a second fluid.

A further object of the invention is to provide only one significant "pathway" along which heat may flow, so as to maximize the efficiency of the heat exchanger.

Yet another object of the invention is to provide a fluid transfer device, such as a pipe of any size or shape, which is divided into segments, adjacent segments of which are thermally insulated or isolated from adjacent segments, so that, heat transfer may be maximized within, and out of, each isolated segment, while minimizing heat transfer between adjacent segments.

Yet another object of the invention is to provide a device, system, and method for recovering so-called "waste" energy in industrial and residential applications so that such waste energy may be utilized in order to conserve natural resources, as well as to reduce costs.

Another object of invention is to provide a system for maximizing heat transfer applicable in all industries, residential applications, boiler systems, power plants, cryogenic (liquid gas process) systems, radiators, air conditioners, and refrigeration systems, for example.

A still further object of the invention is to optimize the temperature of the fluid within an isolated zone or segment for maximizing the temperature difference between adjacent isolated (or thermally insulated) segments and between an adjacent body or bodies to which the heat is to be transferred.

A further object of the invention is to reduce the length of known heat exchangers.

A further object of the invention is to achieve higher temperatures in a heat transfer systems, such as conduits containing a heated fluid, such higher temperatures achieving greater and more efficient heat transfer between such conduits and the object to be heated.

Another object of the invention is to provide a heat exchanger applicable to tube-in-tube, tube-in-shell, and flat plate heat exchangers, as well as solar collectors, countercurrent flow heat exchangers, and parallel flow heat exchangers.

Another object of the invention is to provide a heat exchanger system applicable to solid, liquid, and gaseous heat exchangers, usable for both heating and cooling purposes.

Yet another object of the invention is to ensure that the maximum thermal exchange occurs in each zone between the zone and an adjacent object, such as a countercurrent fluid flow or a solid, with which adjacent object heat transfer occurs.

Another object of the invention is to optimize countercurrent flow rates and volumes depending on the heat capacity of the respective materials for optimizing heat transfer.

A yet still further object of the invention is to provide a substantially flat heat exchanger, which maximizes the surface area between the flows, which maximizes heat transfer in the desired direction and to the desired body, i.e., object or fluid, to be heated.

Another object is to provide a heat exchanger having thermally isolated sections that is compact, e.g., it achieves the required heat transfer rates and temperature gradients of longer systems.

In summary, the invention is directed to a waste energy recovery system including a heat exchanger having a first fluid transfer device and a second fluid transfer device. The first fluid transfer device has an inlet and an outlet, and is configured for carrying a heated fluid from its inlet to its outlet. The second fluid transfer device has an inlet and an outlet and is configured for carrying an unheated fluid from its inlet to its outlet. The first fluid transfer device may be provided with two (2) fluid transfer sections, each such section being connected and separated by an insulating or isolating connector disposed therebetween. The insulating connector has greater insulating characteristics than at least one of the two fluid transfer sections.

The invention likewise is directed to a method of using the inventive waste energy recovery system for recovering waste energy.

In addition, the invention is directed to the novel components, such as the fluid transfer device being subdivided into two or more fluid transfer sections, adjacent ones of the fluid transfer sections being connected by respective insulating connectors so that heat transfer is minimized along the length of the fluid transfer device, while heat transfer is maximized out of and away from each thus isolated fluid transfer section to a respective body or bodies to be heated (or cooled).

It will be understood that relative terms such as up, down, left, and right are for convenience only and are not intended to be limiting.

It should likewise be understood that the fluid transfer device is not intended to be limited to engine manifolds, flash steam conduits formed in furnaces of power plants, pipes, tubes or the like, yet includes any device which conveys a gas, liquid, semi-solid, or solid from one location to another for transferring heat from such a conveyed fluid or solid. The terms insulated and isolated are intended to be used interchangeably, the term isolated emphasizing that the insulated fluid transfer section of a fluid transfer device, for example, is thermally isolated (insulated) from adjacent fluid transfer section(s).

BRIEF DESCRIPTION OF THE DRAWINGS

FIG. 4 is perspective view of a further heat transfer device according to the invention in which multiple heat transfer devices in the form of pipes or tubes are disposed in a common pipe or tube, which common pipe or tube may be insulated;

FIG. 5 is a sectional view taken along line 5—5 of FIG. 6 of an embodiment of a heat exchanger according to the invention;

FIG. 6 is sectional view taken along line 6—6 of the embodiment of FIG. 5;

FIG. 7 is a front perspective view of an insulated segment of the heat transfer device of FIG. 5;

FIG. 8 is a rear perspective view of an insulated segment of the heat transfer device of FIG. 5;

FIG. 9 is a schematic sectional view of a heat transfer device according to the invention, particularly suited for use in a flattened form;

DETAILED DESCRIPTION OF THE INVENTION

Figure 1:
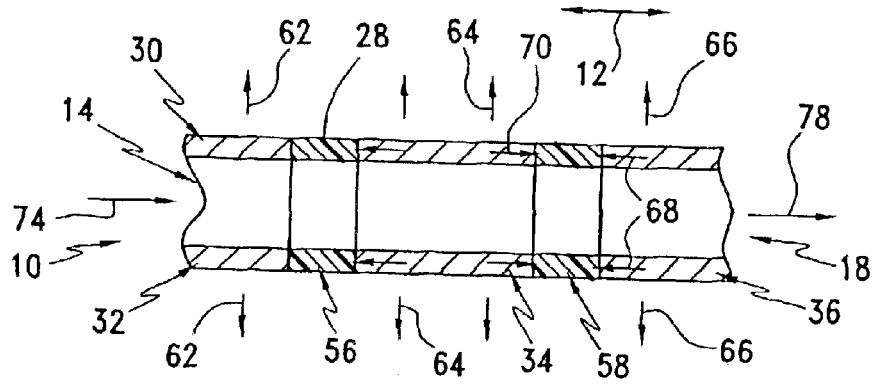
FIG. 1 is a schematic sectional view of an embodiment of a heat transfer device 10 according to the invention that maximizes the temperature gradient along its length as well as relative to the environment in which it is located in order to maximize heat transfer between it and its environment or between it and another object in thermal contact with heat transfer device 10.

FIG. 1 illustrates a heat transfer device 10 according to the invention.

Fundamentally, heat transfer device 10 maximizes heat transfer between a fluid and an adjacent body, such as the environment, or a further unillustrated heat transfer device 10 by maximizing a temperature gradient both along its length 12 and between the adjacent body (or environment) along sections of the heat transfer device 10.

Heat transfer device 10 may include an inlet 14 and an outlet 18, defined by a wall 30, and one or more heat transfer sections 32, 34, and 36.

A heated or unheated fluid hotter or colder than the environment may flow from inlet 14 to outlet 18 depending on whether or not the fluid is to be cooled or heated (or whether the environment is to be heated or cooled), depending on the intended use (or the perspective one takes).

Good results have been achieved when an insulating or isolating connector is disposed between one or more heat transfer sections; e.g., an insulating segment 56 between heat transfer sections or segments 32 and 34, and an insulating segment 58 between heat transfer sections 34 and 36. The material of respective insulating segments 56, 58 may be selected so that the insulating segment 56, for example, has greater resistance to heat transfer than one or both of adjacent heat transfer sections 32 and 34. In that manner, section 32 is thermally insulated or isolated from section 34. Good results have been achieved when the insulating characteristics of segment 56 are selected so that heat transfer along length 12 of the transfer device 10, e.g., between individual sections 32 and 34, for example, is minimized.

As heat is transferred from (or to) another body or the environment, as shown by heat transfer arrows 62, 64, and 66, such heat transfer is maximized thanks to minimizing heat transfer 68 and 70 along the length 12 of device 10 from one fluid section 32, 34, 36 to another. Thus, the temperature drop (i.e., outlet temperature relative to inlet temperature) of a fluid flowing into device 10 at 74 and out at 78 is maximized, and overall heat transfer to another body as shown by heat transfer arrows 62, 64, and 66 is maximized. The heat transfer along length 12 from segments 32 to segment 34 and from segment 34 to segment 36 is minimized and concurrently, heat transfer "outwardly" away from device 10 to an adjacent body or the environment as represented by heat transfer arrows 62, 64, and 66 is maximized, thus the temperature gradient or "drop" of the mass of fluid flowing from inlet 74 to outlet 78 is maximized.

Device 10 may be termed an isolated zone heat exchanger thanks to its use of segments 32, 34, and 36 thermally isolated from each other by respective isolating segments 56 and 58.

If isolation segments 56 and 58 were not present as is the case in prior art devices, heat would be more readily transferred from segment 32 to segment 34 than is the case in inventive device 10, and the thus transferred heat would be transferred, in turn, to the fluid flowing in segment 34. Thus, the temperature gradient along length 12 would be less than is the case in device 10, and consequently, less thermal transfer would occur between device 10 and an adjacent body or the environment.

Heat transfer device 10 may be termed a radiator, as device 10 is suited for use in warming its environment in the case where a fluid, for example, hotter than the ambient temperature of the environment is introduced into inlet 14, flows in direction 74 while radiating heat outwardly as shown by arrow 62, 64, and 66, as described above, and then exits at outlet 78. It will be readily appreciated that fluid introduced into inlet 14 that is colder than the environment would cool the environment thanks to heat being radiated from the environment to the colder fluid and the desired cooling effect would be achieved.

Figure 2:
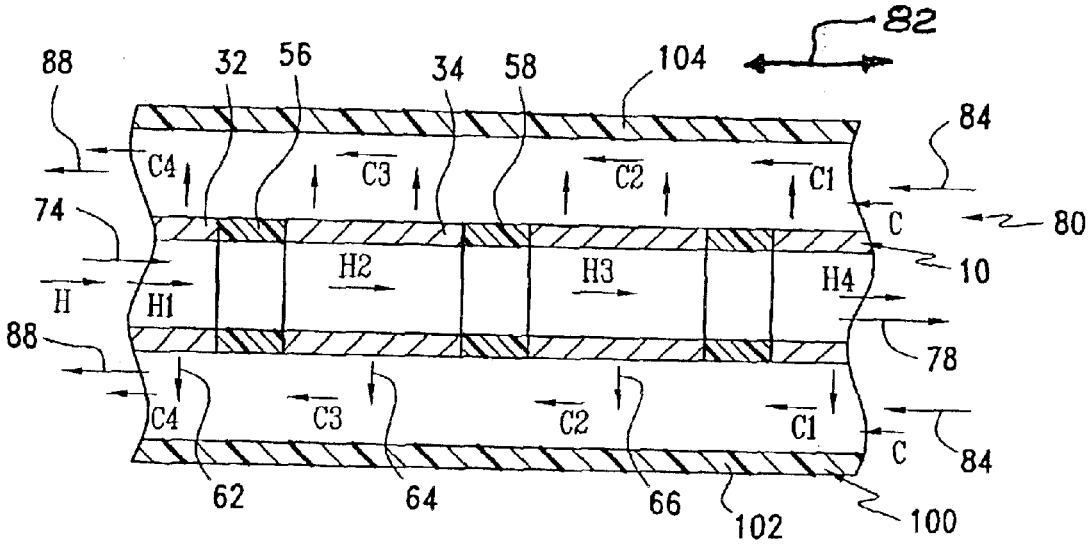
FIG. 2 is a schematic sectional view of another embodiment of a heat transfer device according to the invention.

FIG. 2 illustrates another heat transfer device in the form of an isolated zone heat exchanger 80, for example, suited for transferring heat from one fluid to another, such as for recovering undesired or "waste" heat in a power plant or from the heated water of a water-cooled engine.

Heat exchanger may include heat transfer device 10 divided into isolated sections 32, 34, and so forth defined by respective isolating segments 56, 58, and so forth.

A first fluid H may flow into heat exchanger 80 in direction 74 and out of device 10 in direction 78. Countercurrent or counterflow of a second fluid C, to which heat from the first fluid H is transferred, flows through heat exchanger 80 in a direction going from an inlet 84 to an outlet 88.

Heat exchanger 80 may be disposed within an insulated shell 100 including insulated walls 102 and 104. A shell made of metal and other thermally conductive material may encase the insulated shell 100, depending on the intended use.

Consideration of a possible use of heat exchanger 80 will enhance understanding of the temperature gradients and heat exchange maximized in heat exchanger 80. For discussion purposes, a fluid H flowing in direction 74 may be considered a hot or heated fluid and a fluid C flowing in direction 84 may be considered a cold or cooled fluid. Namely, fluid H may be considered hotter than fluid C for the discussion below.

Hot fluid H flows into thermally isolated section 32 and radiates heat away from section 32 in the direction of arrow 62. More particularly, heat from flow H1 is conducted or transferred to section 32, which in turn conducts or transfers heat to fluid C4 in the direction of arrow 62. Little heat is transferred along the length of wall 30 device 10 from section 32 to section 34, owing to the insulating quality of insulating segment 56 which interrupts wall 30 along its length. The heat is radiated outwardly from region H1, or exchanged with a region C4, in its associated fluid-filled region defined by shell 100. Fluid H1 in that portion of flowing fluid H transfers heat to a quantity of fluid C4 of fluid C flowing within shell 100. Fluid portion C4 cools fluid portion H1. The temperatures of fluid H and C in a fluid region adjacent isolating segment 56 will be ignored for ease of discussion.

In the next heat exchanging region in section 34, a fluid portion H2 exchanges heat with an adjacent fluid portion C3, fluid portion C3 cooling fluid portion H2, and portion H2 heating fluid portion C3. Further along the path of travel of fluid H and a fluid portion H3, and a fluid portion C2 heat and cool each other respectively. Still further along, a fluid portion H4 and a fluid portion C1 respectively heat and cool each other.

By maximizing the thermal gradient along the length 82 of heat exchanger 80, temperature transfer (heat transfer) is maximized between the adjacent regions and overall temperature transfer (heat transfer) is maximized.

Figure 3:
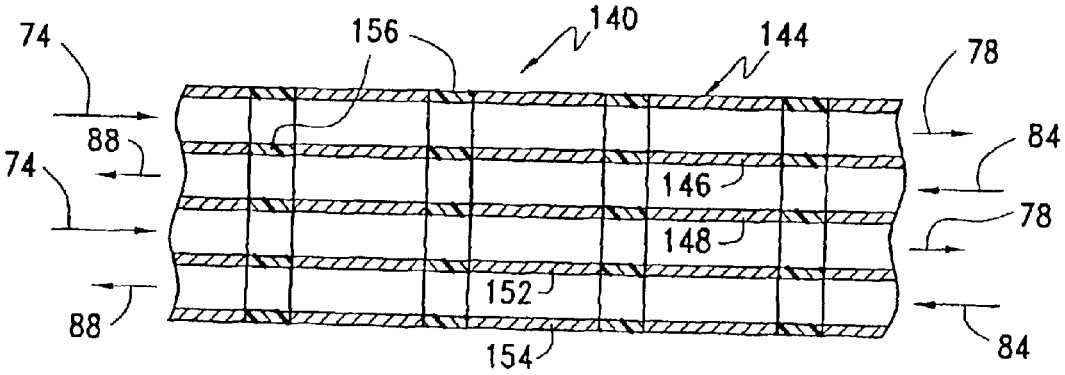
FIG. 3 is a schematic sectional view of another heat transfer device according to the invention in which multiple heat transfer devices in the form of integrally attached plate-like tubes are disposed adjacent to each other.

FIG. 3 illustrates another embodiment of a heat exchanger 140 having isolated zones or sections, similar to the heat exchanger 80 of FIG. 2, yet with a wall or array 144 being provided that may include one or more common walls 146, 148 and 152. Common walls 146 and so forth, facilitate heat transfer between the fluid in adjacent regions or zones of fluids of differing temperatures. The operation may be carried out in substantially the same fashion as the operation of the isolated zone heat exchanger described herein.

FIG. 4 illustrates another embodiment of an isolated zone heat exchanger 200 according to the invention.

Isolated zone heat exchanger 200 may include a wall 202, which may be insulated depending on the intended use, and a plurality of individual isolated zone heat exchangers 10, as described above.

A heated fluid may be introduced into exchanger 10 in the direction of arrow 74, and exited in the direction of arrow 78, such introduction of fluid being done in one or more heat exchangers 10. Likewise, a colder or cooled fluid 84 may be introduced in the direction of arrow 84, and exited in the direction of arrow 88. In the case where the fluid introduced at 74 is hotter than the fluid exiting at 88, the fluid within heat exchangers 10 will heat up the fluid found within the shell or outer tube defined by wall 202. Alternatively, a relatively hot fluid could be introduced at 84 for heating relatively cold fluid introduced into one or more heated exchangers 10.

FIGS. 5–8 illustrate another embodiment of an isolated zone heat exchanger 250 having a housing or shell 270 configured for enclosing a typically counterflowing fluid and the space defined between an isolated zone heat exchanger disposed within shell 270.

Heat exchanger 290 may include heat conductive segments 272 and 274, for example, each of which define a fluid conduit 280 therein.

One or more respective thermally isolating segments 288 may be provided between adjacent sections 272, 274, and so forth.

FIGS. 7 and 8 illustrate perspective views of isolated section 272 of exchanger 290 having a male coupling 276 and a respective mating female coupling 278. One or more fluid conduits 280 and 282 may be provided.

Fluid conduits 280 and 282 may be substantially flat for increasing the surface to volume ratio of the conduits for enhancing thermal transfer between a fluid provided therein and the defining section 272, and hence, enhancing heat transfer to a counterflowing fluid outside of section 272 to which the heat is to be transferred. For example, thermal energy of a heated fluid introduced at 74 into substantially flat tubes 280 and 282 may thus be readily transferred to other fluid introduced at 84 and flowing past isolated section 272. The temperature of a fluid introduced at 74 may be greater than the temperature of a fluid introduced at 84, thereby resulting in heat transfer from fluid at 74 to fluid exiting at 88, and heat transfer between cooled heated fluid exiting at 78 and unheated cooler fluid introduced at 84. Depending on the intended use of isolated zone heat exchangers 250, a fluid introduced at 74 may be initially cooler than a fluid introduced at 84, whereby a greater quantity of thermal energy is transferred from the fluid introduced at 84 to the fluid introduced at 74, so that fluid introduced at 84 heats up the fluid introduced at 74.

An isolating or insulating layer of material 288 may be provided on the female end, as shown, or on the male end, or on both the female and male ends.

In use, thanks to male coupling 276 and female coupling 278, and the isolating segment 288, individual segments 290 may be readily joined together to form an isolated zone heat exchanger. A suitable adhesive or other fastening means may be provided between adjacent segments during assembly of the individual segments 272, 274, with or without a fluid type seal depending on the intended use.

FIG. 9 illustrates another embodiment of an isolated zone heat exchanger 320 according to the invention, which may likewise be provided with an array 340 of thermally isolated and segmented fluid conduits, isolated by the provision of thermal insulators 356, 358, and so forth.

A housing or shell 330, which may be insulated, may likewise be provided that defines a space between shell 330 and the array 340 of heat exchangers, which space receives the fluid introduced in direction 84. As in previous embodiments, a further counterflowing fluid is introduced at 74 so that it may be heated or cooled by the fluid introduced at 84.

Figure 10:
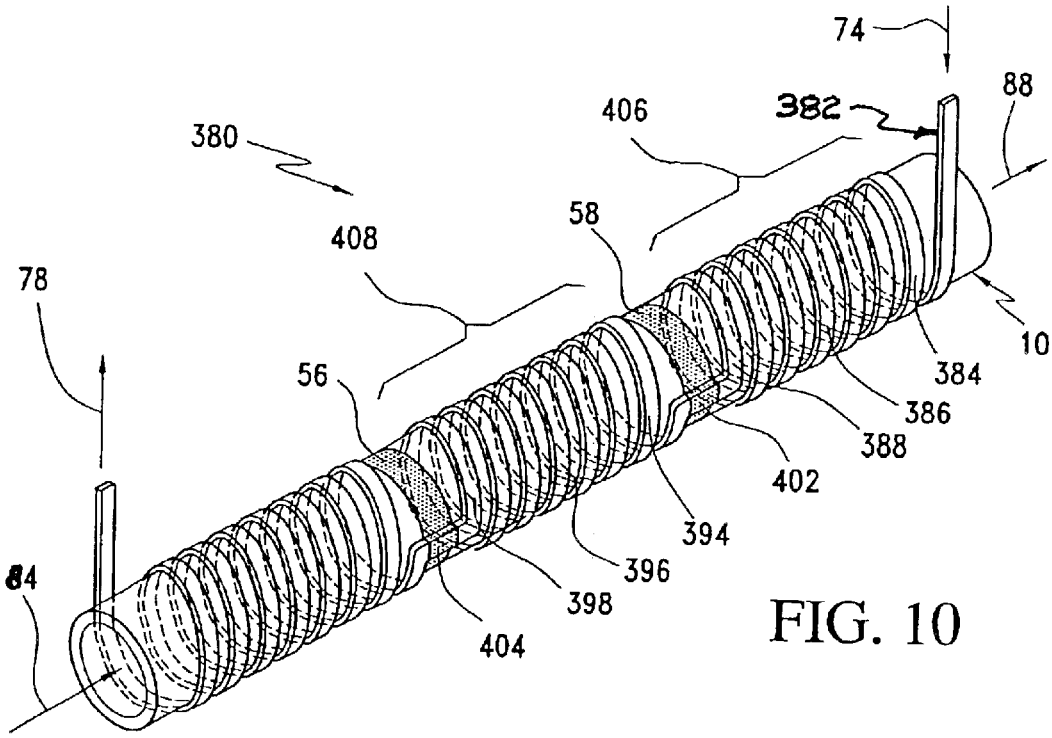
FIG. 10 is another embodiment of a heat transfer device according to the invention, usable as a waste energy recovery or "instant" hot water heater.

FIG. 10 illustrates another embodiment of an isolated zone heat exchanger 380 which may be used as a so-called "instant" hot water heater, for example.

Instant hot water heater 380 will be discussed taking the point of view that a heated fluid may be introduced in the direction of arrow 74 into an at least partially coiled tube 382 including coils 384, 386, 388, 394, 396, 398, and so forth.

A respective isolating or insulating segment 402 and 404 may be provided between respective groups of coils 406 or 408, for example.

The coiled tube 382 may be provided around heat exchanger 10, as described above. Coiled tube 382 may have a substantially flat (e.g., rectangular, thin-walled) configuration to maximize the fluid flow in "contact" with the surface of the pipe carrying fluid to be heated that is introduced at 84. The configuration of the conduit carrying fluid to be heated may likewise be varied to maximize the amount of contact area of the wall of the conduit in contact with pipe 382 and, hence, in "contact" with the fluid introduced at 74.

For ease of discussion, it will be assumed that a heated fluid will be introduced into coiled tube 382, which heated fluid has been heated by an on-demand heater or furnace, such as a natural gas burner. In such a case, coiled tube 382 may be considered the heating tube or heating coil which heats heat exchanger 10, and hence, the fluid in exchanger 10.

Tube 382 may be part of a closed loop system.

In the case where the heated water is for human consumption, such as for heating water to be used in a residential kitchen, the fluid introduced at 84 may be drinkable water.

Thanks to the temperature gradient achieved between the fluid introduced at 74 cooled along its path of travel, and exiting at 78, heat exchange will be efficient and rapid. The cooling of the fluid in coiled tube 382 corresponds to the desired heating of the water in heat exchanger 10, along the lines described.

Figure 11:
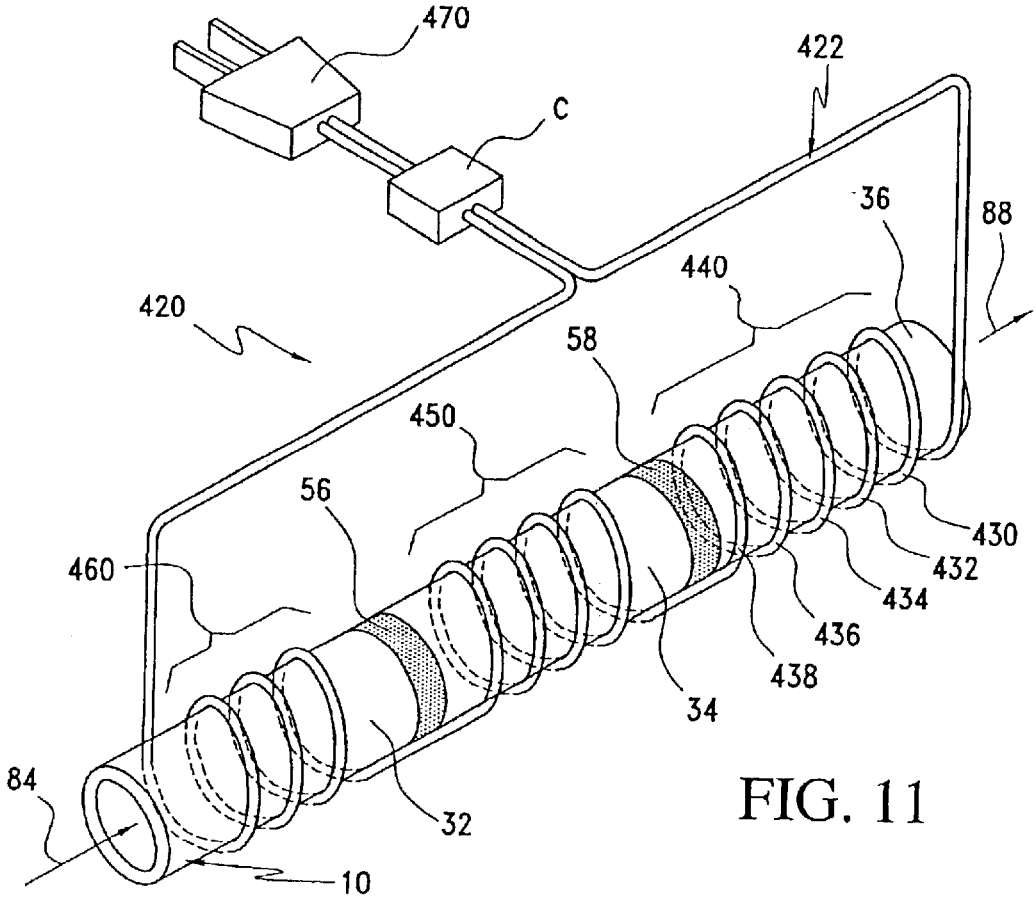
FIG. 11 is a further embodiment of a heat transfer device usable as an "instant" hot water heater, for example, in which an electric heater element is analogous to the coiled, fluid-carrying tube of the FIG. 10 embodiments.

FIG. 11 illustrates a further preferred embodiment of a heat exchanger 420 according to the invention. In heat exchanger 420, an electric coil 422 has been used as a heat source for heating a fluid introduced at 84 into isolated zone heat exchanger 10.

A series of coils 430, 432, 434, 436, and 438 is provided in a first group of coils 440 (5 coils total, for example), four (4) heating coils are provided in a grouping 450, and three heating coils are provided in a grouping 460. These groupings 440, 450, 460 have been selected to illustrate the assumption that each electrically heated coil 430, 432, and so forth, of electric heating element 422 is heated an equal amount when electricity flows. This assumption is for ease of discussion. Different fluids and heating coil properties will require variation readily determined, in practice.

Likewise, the unheated or coldest fluid is introduced at 84, and the heated hottest fluid is exited at 88. By providing five electric heating coils in group 440, the isolated segment 36 is provided with a relatively large thermal gradient.

Further, the provision of four coils in grouping 450 in isolated segment 34 having the less heated fluid 84 therein maintains a large gradient between the less heated fluid, and the three heating coils in grouping 460 provide less overall heat, yet the fluid introduced at 84 in isolated segment 32 is least heated in segment 32 and, hence, the temperature gradient between the electrical coil grouping 460 and the initially unheated fluid is still maximized.

It will be appreciated that there will be cooling of the heated heating coils groupings 440, 450, and 460, just as there is cooling of the groupings of fluid-filled coils 406 and 408 in the FIG. 10 embodiment.

A plug 470 for plugging heater 420 into an electrical outlet may be provided, as well as a control C for controlling operation as will be readily understood as such controls C are available or readily constructed with conventional components.

In both the instant hot water heater of embodiment 420 of FIG. 11 and the instant hot water heater 380 of FIG. 10, the size, number, and spacing of the respective heating coils and groupings will be varied depending on the requirements and intended use.

A dryer, such as for drying clothes, could be made more energy efficient by using so-called waste energy (i.e., energy not used for the drying process) to heat the fluid used in the drying process. For example, a conventional electric clothes dryer in which the heated air used for drying wet clothes is heated by an electric heater and heated moist exhaust air vented from the dryer and typically exited to the atmosphere may have its energy efficiency enhanced as follows. One could use one or both of the embodiments of FIGS. 10 and 11 to enhance the operation of the clothes dryer by scavenging waste energy from the vent pipe carrying moisture-laden heated air and using the scavenged or recovered waste heat to heat the incoming fluid in the form of dry air to be heated. In such a case, one may consider the heat exchanger 380 of FIG. 10 as representative of the dryer exhaust pipe and the electrically heated fluid heat exchanger 420 of FIG. 11 to be the apparatus with which one will heat the dry air to provide heated dry air to the dryer for drying clothes therein. The embodiment of FIG. 10 may be used in addition to the embodiment of FIG. 11 to supplement the heat provided by the FIG. 11 embodiment for heating the incoming air to be heated. If the FIG. 10 embodiment is used instead of the FIG. 11 embodiment for heating incoming air a conventional air heating device may be used to heat incoming air that has been modified to account for the lower heating requirement necessary thanks to the waste heat being recovered by the heat exchanger of FIG. 10 supplementing the modified conventional heating apparatus for heating incoming air. In a commercial setting, such as in a laundromat with multiple dryers, the waste heat from multiple dryers may be recovered to supplement or completely replace the heat required to heat incoming air in one of the number of dryers. For example, if 10 dryers are in use, 9 or 10 of the dryers may be provided with the heat exchanger of 380 of FIG. 10 and provide enough recovered waste heat from the moisture-laden vented exhaust air to provide all the heat required to heat the incoming unheated dry air of the $10^{th}$ dryer, for example. That is merely an example of a use to which the embodiments of FIGS. 10 and 11 may be put.

Figure 12:
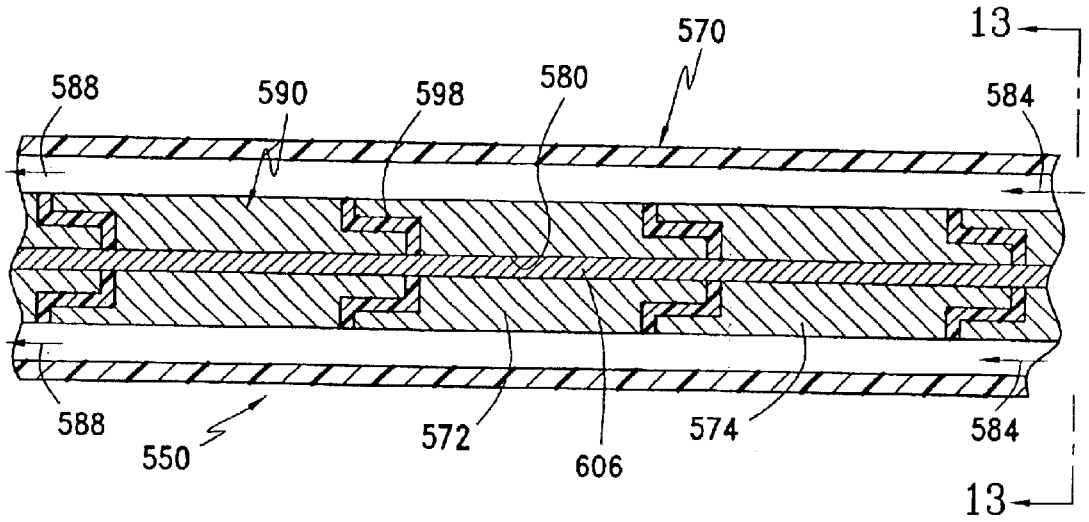
FIG. 12 is a sectional view taken along line 12—12 of FIG. 13 of another heat transfer device according to the invention.
Figure 13:
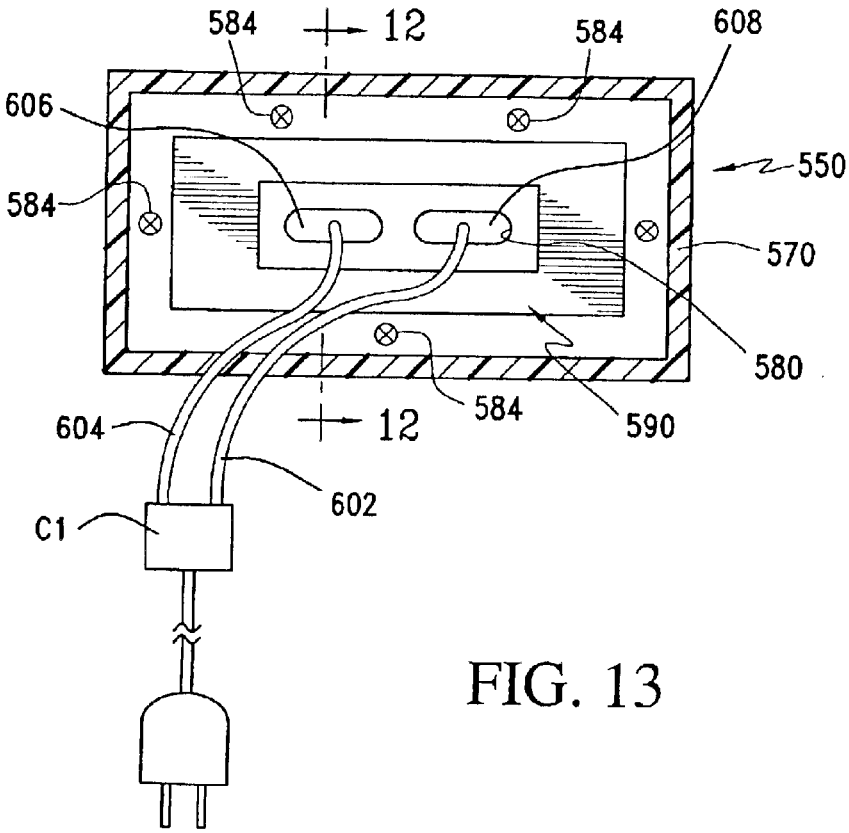
FIG. 13 is a sectional view taken along line 13—13 of the embodiment of FIG. 12.

FIGS. 12 and 13 illustrate a further preferred embodiment of a heat exchanger 550 according to the invention.

FIGS. 12 and 13 illustrate another embodiment of an isolated zone heat exchanger 550 having a housing or shell 570 configured for enclosing a typically counterflowing fluid and the space defined between an isolated zone heat exchanger disposed within shell 570.

Heat exchanger 590 may include heat conductive segments 572 and 574, for example, each of which define a fluid conduit 580 therein.

One or more respective thermally isolating segments 598 may be provided between adjacent sections 572, 574, and so forth.

One or more heating elements 606, 608 may be provided that may be electric and controlled by a control C1 readily constructed to yield the desired features.

Heating elements 606, 608 and associated conduit 580 may be substantially flat for increasing the surface to volume ratio of the conduits for enhancing thermal transfer between heating elements 606, 608 and the defining section 572, 574 and hence, enhancing heat transfer to a counterflowing fluid outside of section 572, 574 to which the heat is to be transferred. For example, thermal energy of heated elements 606, 608 may thus be readily transferred to fluid introduced at 584 and flowing past isolated sections 572, 574 for example. The temperature of heating elements 606, 608 may be greater than the temperature of a fluid introduced at 584, thereby resulting in heat transfer from heating elements 606, 608 to fluid exiting at 588. Depending on the intended use of isolated zone heat exchangers 550, the size and the configuration of elements 606, 608, an isolating or insulating layer of material 588 may be provided on the female end, as shown, or on the male end, or on both the female and male ends.

In any of the above-described embodiments, and consistent with the invention, the use of uninsulated versus insulated housings, the use or non-use of housings, the number of counterflowing fluid paths, the configuration and cross-sectional areas of fluid paths, and all other features may be varied, added or subtracted, depending on the intended use.

For ease of discussion, given that such will be readily apparent to a person having ordinary skill in the art, discussion of heat/mass transfer rates, conductivity, fluid flow rates, and so forth, have been minimized. It will be appreciated that the choice of heating/cooling fluids, with or without additives, the varying of fluid flow rates, mass flow rates, and the selection of thermal conductivity parameters of the devices defining the fluid path and those of adjacent counterflowing fluid paths, may be varied depending on the intended use, and are within the scope of a person having ordinary skill in the art.

It is likewise contemplated that the size, material, insulating properties, and configuration of the insulating segments, the conduits or the tubes, the housing, the fluid flow path, and the like, may be varied depending on the intended use. It is contemplated that the conductive fluid pathway when formed as tubes may include tubes of the same size, or different sizes type.

Parallel flow in addition to or instead of countercurrent flow systems may be used.

Better results have been achieved by use of thermally conductive fluid-filled tube, such as a metal tube with an isolated segment disposed and thermally isolating adjacent sections of the metal tube, as compared with a metal tube of the same length and flow volume having no thermally isolated section isolated by isolating segments. A greater temperature difference between the inlet and outlet of the tube having the thermally isolating segment, as compared with the inlet and outlet temperature difference of the metal tube having no thermally isolated segment, has been demonstrated.

It will be appreciated that any of the materials of the tubes, conduits, pipes, isolating segments, shells, housing, and so forth may be varied depending on the intended use, the variation including but not limited to various metals such as steel, cast iron, copper, stainless steel, ceramics, and so forth. The insulating material of the isolating segments may be any of a variety of sufficiently thermally isolating materials to achieve a desired temperature gradient depending on the intended use, including but not limited to epoxies, plastics, synthetic materials, rubber, ceramics, and so forth.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A waste energy recovery system, comprising:

a) a heat exchanger;

b) the heat exchanger including:

i) a first fluid transfer device, the first fluid transfer device having an inlet and an outlet;

ii) the first fluid transfer device being configured for conveying a heated fluid from its inlet to its outlet;

iii) a second fluid transfer device, the second fluid transfer device having an inlet and an outlet; and iv) the second fluid transfer device being configured for conveying an unheated fluid from its inlet to its outlet;

c) the first fluid transfer device having first and second fluid transfer sections;

d) the inlet of the first fluid transfer device being provided in its first fluid transfer section, and the outlet of the first fluid transfer device being provided in its second fluid transfer section;

e) an insulating segment being provided substantially between the first and second fluid transfer sections of the first fluid transfer device; and f) the insulating segment having greater insulating characteristics than at least one of the first and second fluid transfer sections.

2. A waste energy recovery system as in claim 1, wherein:

a) the insulating segment fluidly connects the first and second fluid transfer sections.

3. A waste energy recovery system as in claim 1, wherein:

a) the first and second fluid transfer devices are completely free of direct physical contact with each other.

4. A waste energy recovery system as in claim 1, wherein:

a) the second fluid transfer device includes a first fluid transfer section and a second fluid transfer section; and b) an insulating segment is provided between the first and the second fluid transfer sections of the second fluid transfer device.

5. A waste energy recovery system as in claim 4, wherein;

a) the inlet of the second fluid transfer device is provided in its first fluid transfer section, and the outlet of the second fluid transfer device is provided in its second fluid transfer section; and b) the first fluid transfer section of the first fluid transfer device thermally contacts the second fluid transfer section of the second fluid transfer device; and c) the second fluid transfer section of the first fluid transfer device thermally contacts the first fluid transfer section of the second fluid transfer device.

6. A waste energy recovery system as in claim 5, wherein:

a) the first fluid transfer device includes a first pipe.

7. A waste energy recovery system as in claim 1, wherein:

a) the first fluid transfer device includes a first pipe.

8. A waste energy recovery system as in claim 7, wherein:

a) the second fluid transfer device includes a second pipe.

9. A waste energy recovery system as in claim 6, wherein:

a) the second fluid transfer device includes a second pipe.

10. A waste energy recovery system as in claim 9, wherein:

a) the second pipe includes a plurality of pipes, each pipe of the plurality of pipes includes a first and second fluid transfer section, each of which thermally contacts the respective second and first fluid transfer sections of the first fluid transfer device.

11. A waste energy recovery system as in claim 5, wherein:

a) the first fluid transfer section of the first fluid transfer device physically contacts the second fluid transfer section of the second fluid transfer device.

12. A waste energy recovery system as in claim 1, wherein:

a) the insulating segment has greater insulating properties than both of the first and second fluid transfer sections.

13. A waste energy recovery system as in claim 7, wherein:

a) the first pipe includes a substantially flat configuration.

14. A waste energy recovery system as in claim 13, wherein:

a) the first pipe includes a plate defining the substantially flat configuration.

15. A heat exchanger, comprising:

a) a fluid transfer device, the fluid transfer device having an inlet and an outlet;

b) the fluid transfer device being configured for conveying a fluid from its inlet to its outlet;

c) the fluid transfer device having first and second fluid transfer sections;

d) the inlet of the fluid transfer device being provided in its first fluid transfer section, and the outlet of the fluid transfer device being provided in its second fluid transfer section;

e) an insulating segment being provided substantially between the first and second fluid transfer sections of the fluid transfer device; and f) the insulating segment having greater insulating characteristics than at least one of the first and second fluid transfer sections.

16. A heat exchanger as in claim 15, wherein:

b) the insulating segment fluidly connects the first and second fluid transfer sections.

17. A heat exchanger as in claim 15, wherein:

a) the first fluid transfer device includes a first pipe.

18. A heat exchanger as in claim 15, wherein;

a) each of the first and second fluid transfer devices includes a relatively thin and wide fluid pathway adjacent respective walls of the first and second fluid transfer devices for maximizing the surface area of the respective walls of the first and second fluid transfer devices that are in contact with each other.

19. A heat exchanger as in claim 15, wherein:

a) the insulating segment completely separates the first fluid transfer section about the second fluid transfer section.

20. A fluid heater, comprising:

a) a heat exchanger;

b) the heat exchanger including:

a) a first fluid transfer device, the first fluid transfer device having an inlet and an outlet;

ii) the first fluid transfer device being configured for conveying a heated fluid from its inlet to its outlet;

iii) a second fluid transfer device, the second fluid transfer device having an inlet and an outlet; and iv) the second fluid transfer device being configured for conveying an unheated fluid from its inlet to its outlet;

c) the first fluid transfer device having first and second fluid transfer sections;

d) the inlet of the first fluid transfer device being provided in its first fluid transfer section, and the outlet of the first fluid transfer device being provided in its second fluid transfer section;

e) an insulating segment being provided substantially between the first and second fluid transfer sections of the first fluid transfer device;

f) the insulating segment having greater insulating characteristics than at least one of the first and second fluid transfer sections; and g) a heating element being provided adjacent the first fluid transfer device, the heating element being configured for heating at least one of the first and second fluid transfer sections.

21. A fluid heater as in claim 20, wherein:

a) the heating element includes an on-demand heating element.

22. A fluid heater as in claim 20, wherein:

a) the heating element includes an electric heating element.

23. A fluid heater as in claim 20, wherein:

a) the second fluid transfer device being configured for transferring water.

24. A fluid heater, comprising:

a) a heat exchanger;

b) the heat exchanger including:

i) a fluid transfer device, the fluid transfer device having an inlet and an outlet; and ii) the fluid transfer device being configured for conveying a heated fluid from its inlet to its outlet;

c) the fluid transfer device having first and second fluid transfer sections;

d) the inlet of the fluid transfer device being provided in its first fluid transfer section, and the outlet of the first fluid transfer device being provided in its second fluid transfer section;

e) an insulating segment being provided substantially between the first and second fluid transfer sections of the fluid transfer device;

f) the insulating segment having greater insulating characteristics than at least one of the first and second fluid transfer sections; and g) a heating element being provided adjacent at least of the first and second fluid transfer sections of the first fluid transfer device for heating the at least one fluid transfer section.

25. A fluid heater as in claim 24, wherein:

a) the second fluid transfer device is configured for transferring water.

26. A fluid heater as in claim 24, wherein:

a) the heating element is substantially surrounded by the first fluid transfer device.

* * * * *